United States Patent [19]

Pavlak et al.

[11] Patent Number: 4,641,911

[45] Date of Patent: Feb. 10, 1987

[54] ELECTRICAL CONNECTOR HAVING A FUNNEL WRAP WIRE CRIMP BARREL

[75] Inventors: John J. Pavlak, Youngstown; Charles R. Nestor, Niles, both of Ohio

[73] Assignee: General Motors Corporation, Detroit, Mich.

[21] Appl. No.: 659,079

[22] Filed: Oct. 9, 1984

[51] Int. Cl.[4] ..... H01R 4/18

[52] U.S. Cl. ..... 339/276 T

[58] Field of Search ..... 339/223 R, 276 T, 276 R, 339/223 S

[56] References Cited

U.S. PATENT DOCUMENTS

| | | | |
|---|---|---|---|
| 2,763,849 | 9/1956 | Betts | 339/276 |
| 3,140,142 | 7/1964 | Marquis | 339/276 |
| 3,185,952 | 5/1965 | Potter et al. | 339/17 C |
| 3,235,345 | 2/1966 | Fuller et al. | 29/183.5 |
| 3,521,224 | 7/1970 | Spooren | 339/276 |
| 3,569,919 | 3/1971 | Paddona, Jr. | 339/258 R |
| 3,601,783 | 8/1971 | Loose | 339/223 R |
| 3,805,221 | 4/1974 | Kuo | 339/276 R |
| 3,808,588 | 4/1974 | McGregor | 339/276 T |
| 4,214,361 | 7/1980 | Coldren et al. | 339/220 R |
| 4,371,229 | 2/1983 | Spangler et al. | 339/223 R |

*Primary Examiner*—Gil Weidenfeld
*Assistant Examiner*—Gary F. Paumen
*Attorney, Agent, or Firm*—F. J. Fodale

[57] ABSTRACT

An electrical connector has an attachment means comprising a funnel wrap wire crimp barrel, that is, one which is funnel-shaped in the axial direction and partially overlapped in the circumferential direction. The attachment means further comprises an intermediate, funnel wrap insulation crimp barrel and a funnel-shaped, split guide ring in one embodiment. In a second embodiment, the attachment means further comprises a cylindrical, split insulation crimp barrel.

5 Claims, 17 Drawing Figures

ELECTRICAL CONNECTOR HAVING A FUNNEL WRAP WIRE CRIMP BARREL

This invention relates generally to electrical connectors and, more particularly, to electrical connectors having attachment means for attaching the electrical connector to a conductor which comprise a wire crimp barrel.

It is already known from U.S. Pat. Nos. 2,763,849 (Betts) issued Sept. 18, 1956; 3,521,224 (Spooren) issued July 21, 1970 and 4,371,229 (Spangler et al) issued Feb. 1, 1983 to provide an electrical connector having attachment means which comprise a cylindrical or substantially cylindrical wire crimp barrel which is at least partially overlapped in the circumferential direction for one purpose or another. It is also known from U.S. Pat. No. 3,140,142 (Marquis) issued July 7, 1964 to provide a cylindrical crimp barrel or ferrule which is butt seamed and which has a funnel-shaped flange which is also butt seamed.

The object of this invention is to provide an improved attachment means for electrical connectors in which the attachment means comprise a funnel wrap wire crimp barrel, that is, one which is funnel-shaped in the axial direction and partially overlapped in the circumferential direction. This funnel-shaped, partially overlapped wire crimp barrel facilitates insertion of the conductor wire, accommodates a range of conductor wire diameters, and improves containment of the inserted conductor wire for the subsequent crimping operation, particularly when the conductor wire is stranded.

Electrical connectors comprising such "funnel wrap" wire crimp barrels are particularly useful in preloaded electrical connectors in which one or more electrical connectors are inserted partially or fully into an insulator body before the electrical connector is attached to the conductor wire. See for instance, U.S. Pat. No. 4,214,361 (Coldren et al), issued July 29, 1980.

The attachment means in accordance with this invention may also comprise an insulation crimp barrel and/or a guide ring behind the funnel-shaped, partially overlapped wire crimp barrel which are shaped so that the conductor wire does not hang up on the inner lip of the wire crimp barrel during insertion.

In one embodiment of the invention, the attachment means includes an intermediate funnel-shaped, partially overlapped, insulation crimp barrel and a funnel-shaped, butt seamed guide ring behind the wire crimp barrel.

In this embodiment, the intermediate funnel-shaped insulation crimp barrel may also be sized to prevent the conductor insulation from entering the wire crimp barrel.

In another embodiment of the invention, the attachment means include a cylindrical, butt seamed insulation crimp barrel of reduced size.

Other objects and features of the invention will become apparent to those skilled in the art as the disclosure is made in the following detailed description of a preferred embodiment of the invention as illustrated in the accompanying sheets of drawing in which.

Figure 1:
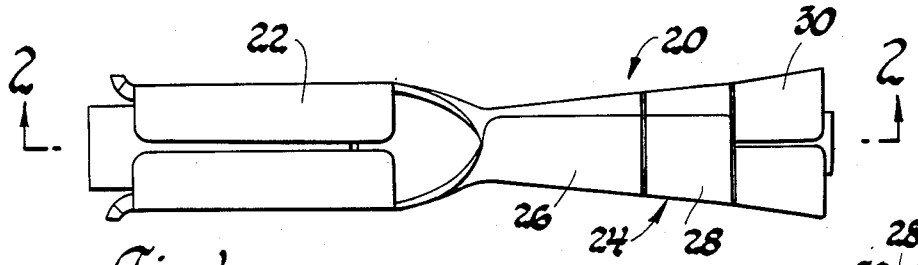
FIG. 1 is a top view of an electrical connector in accordance with a first embodiment of our invention.

Referring now to the drawing and, more particularly, to FIGS. 1-9, a first embodiment of our invention is illustrated in connection with a female electrical connector 20 having a female socket contact 22 at one end and an attachment means 24 at the other end for attaching the electrical connector to an insulated conductor 25.

The attachment means 24 is a funnel-shaped barrel and comprises three funnel-shaped sections, a wire crimp barrel 26, an intermediate insulation crimp barrel 28 and a guide ring 30.

Figure 4:
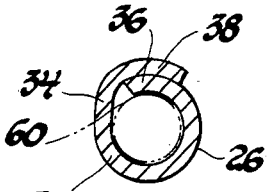
FIG. 4 is a section taken substantially along the line 4—4 of FIG. 2 looking in the direction of the arrows.
Figure 9:
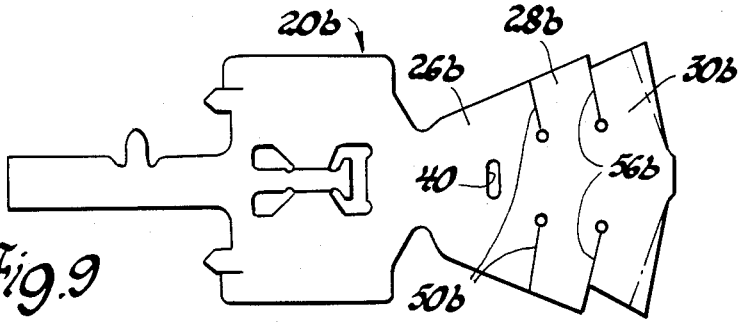
FIG. 9 is a plan view of a blank for making the electrical connector shown in FIGS. 1—8.
Figure 10:
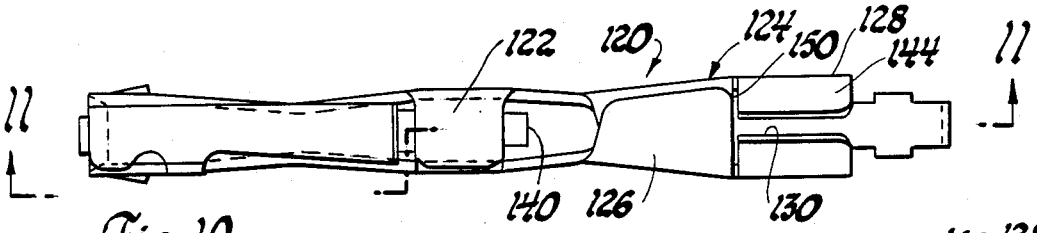
FIG. 10 is a top view of an electrical connector in accordance with a second embodiment of our invention.

The funnel-shaped, wire crimp barrel 26 is formed by rolling up a flat, delta-like portion **26*b* of the connector blank 20*b* shown in FIG. 9 so that the edges overlap approximately 90° in the circumferential direction as shown in FIG. 4**.

The resulting wire crimp barrel 26 comprises a circular lower part 32 and a partially overlapped upper part 34 comprising circular and elliptical segments which respectively provide an inner axial lip 36 engaging the inner surface of an outer axial lip 38 for the length of the wire crimp barrel 26. The lower part 34 has an inspection slot 40.

Figure 5:
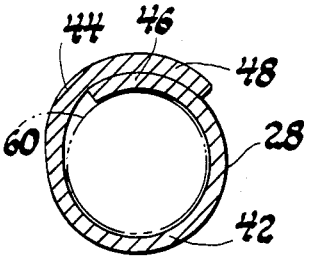
FIG. 5 is a section taken substantially along the line 5—5 of FIG. 2 looking in the direction of the arrows.

The intermediate funnel-shaped insulation crimp barrel 28 is formed by rolling up the flat wing-like blank portion **28*b* shown in FIG. 9 so that the edges also overlap approximately 90° in the circumferential direction as shown in FIG. 5**.

The resulting insulation crimp barrel 28 likewise comprises a circular lower part 42 and a partially overlapped upper part 44 comprising circular and elliptical segments which respectively provide an inner axial lip 46 engaging the inner surface of an outer axial lip 48 for the length of the insulation crimp barrel 28.

Figure 2:
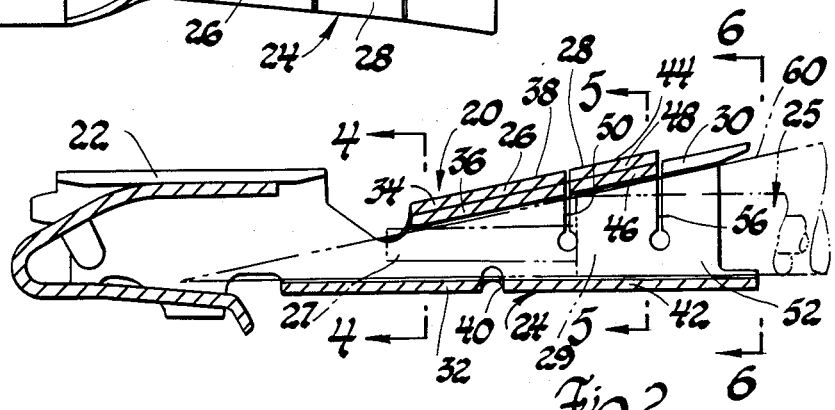
FIG. 2 is a longitudinal section taken substantially along the line 2—2 of FIG. 1 looking in the direction of the arrows.

The lower circular part 42 of the insulation crimp barrel 28 is a contiguous extension of the lower circular part 32 of the conductor wire crimp barrel 26 providing a smooth continuous inner surface as shown in FIG. 2.

The upper partially overlapped parts 34 and 44 of the crimp barrels 26 and 28, however, are separated by a narrow slit 50 which results from the transverse slits **50*b* in the blank which separate the delta-like blank portion 26*b* from the wing-like blank portion 28*b*. The transverse slits 50*b* each have a stress relief hole at its inner end which are generally diametrically opposed when the attachment barrel 24** is formed.

Figure 6:
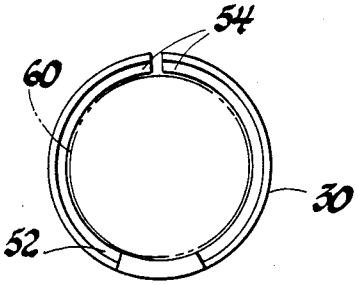
FIG. 6 is an end view taken substantially along the line 6—6 of FIG. 2.

The guide ring 30 is formed by rolling up the flat, wing-like blank portion **30*b* shown in FIG. 9. The edges of the blank portion 30*b* are set in so that the edges confront each other rather than overlap when the blank 30*b* is rolled as shown in FIG. 6. The resulting guide ring 30 is circular. It has a solid circular lower part 52 which is a contiguous extension of the lower parts 32 and 42 of the crimp barrels 26 and 28 and a split circular upper part 54 which is separated from the upper part 44 of the insulation crimp barrel 28 by a narrow slit 56 which results from the transverse slits 56*b*** in the blank.

The inside surface of the attachment barrel 24 circumscribes an imaginary conical surface 60 shown in phantom in FIGS. 2, 4, 5 and 6. As shown in FIG. 4, the majority of the wire crimp barrel 26 including the inner lip 36 lies on the imaginary conical surface 60. As shown in FIG. 5, the majority of the insulation crimp barrel 28 also lies on the imaginary conical surface 60 and the inner lip 46 is behind the inner lip 36 with only the narrow slit 50 therebetween. Consequently, the insulation crimp barrel 28 is shaped so that the conductor wire does not hang up on the inner lip 36 of the wire crimp barrel 26 during insertion.

On the other hand, the entire guide ring 30 lies on the imaginary conical surface 60 so that the split upper part 54 is behind the inner lip 46 with only a narrow slit 56 therebetween. Consequently, the guide ring 30 is shaped so that the conductor wire does not hang up on the inner lip 46 of the insulation crimp barrel 28 during insertion.

The electrical connector 20 is attached to the insulated conductor 25 which is prepared in a well known manner by stripping a length of insulation to expose an end portion of the conductor wire 27 which in this case is stranded. The conductor wire 27 is then inserted into the wire crimp barrel 26 as shown in phantom in FIG. 2. As stated earlier the guide ring 30 and the insulation crimp barrel 28 are shaped so that the conductor wire 27 does not hang up on the inner lips 36 and 46 during insertion. Moreover, the overlapping inner lips 36 and 46 improve containment of the stranded conductor wire 27 inasmuch as not even one strand can pass out of the barrels 26 and 28 between the inner lips 36 and 46 and the cooperating outer lips 38 and 48 which they respectively engage.

The length of the exposed conductor wire 27 is preferably such that it extends out the end of the wire crimp barrel 26 a small amount when the insulation crimp barrel 28 engages the insulation jacket 29 to prevent the insulation jacket 29 entering the wire crimp barrel 26.

Figure 3:
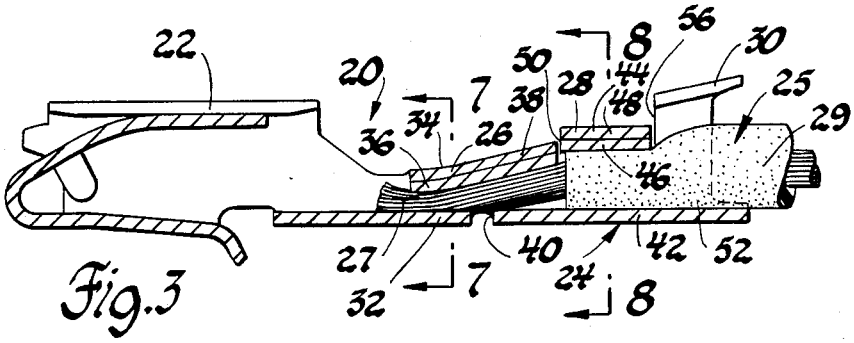
FIG. 3 is a longitudinal section similar to FIG. 2 showing the electrical connector crimped to an insulated conductor wire.
Figure 7:
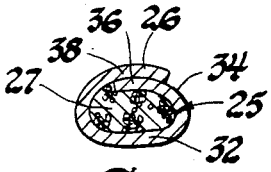
FIG. 7 is a section taken substantially along the line 7—7 of FIG. 3.
Figure 8:
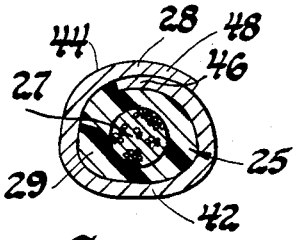
FIG. 8 is a section taken along the line 8—8 of FIG. 3.

The wire and insulation crimp barrels 26 and 28 are then crimped tightly around the conductor wire 27 and the insulation jacket 29 respectively as shown in FIGS. 3, 7 and 8. The wire crimp barrel is crimped by a lower cylindrical crimp die and an upper tapered crimp die so that the resulting crimped wire barrel is tapered in the axial direction as shown in FIG. 3 and D-shaped in cross section as shown in FIG. 7. The insulation crimp barrel is crimped by cylindrical crimp dies so that the resulting crimped insulation barrel is uniform in height in the axial direction as shown in FIG. 3 and D-shaped in cross section as shown in FIG. 8.

Referring now to FIGS. 10–17, a second embodiment of our invention is illustrated in connection with a female electrical connector 120 having a female socket contact 122 of small cross section at one end and an attachment means 124 of reduced size at the other end for attaching the electrical connector to an insulated conductor 125.

The attachment means 124 comprise a "funnel wrap" wire crimp barrel 126 and a cylindrical insulation crimp barrel 128.

Figure 13:
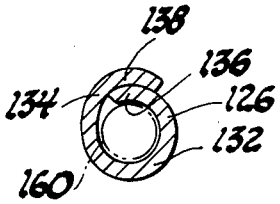
FIG. 13 is a section taken substantially along the line 13—13 of FIG. 11.
Figure 17:
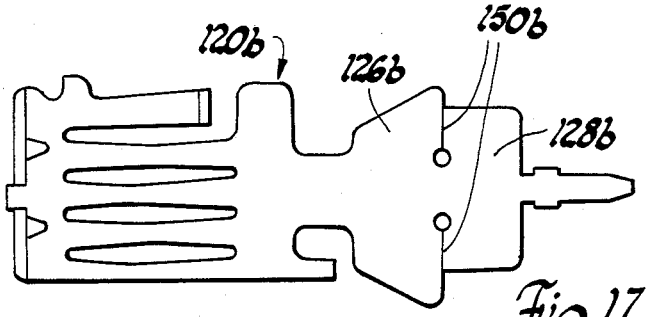
FIG. 17 is a plan view of the blank for making the electrical connector shown in FIGS. 10—16.

The funnel-shaped, wire crimp barrel 126 is formed by rolling up a flat, delta-like portion **126*b* of the connector blank 120*b* shown in FIG. 17 so that the edges overlap approximately 90° in the circumferential direction as shown in FIG. 13**.

The resulting wire crimp barrel 126 comprises a circular lower part 132 and a partially overlapped upper part 134 comprising circular and elliptical segments which respectively provide an inner axial lip 136 engaging the inner surface of an outer axial lip 138 for the length of the wire crimp barrel 126. The electrical connector 120 has a stop tab 140 spaced ahead of the wire crimp barrel 126.

The cylindrical insulation crimp barrel 128 is formed by rolling up the flat rectangular blank portion **128*b* shown in FIG. 17**.

Figure 14:
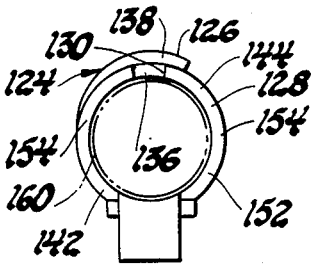
FIG. 14 is an end view taken substantially along the line 14—14 of FIG. 11.

The edges of the blank portion **128*b* are set in so that the edges confront each other and form a gap 130 rather than overlap when the blank portion 128*b* is rolled as shown in FIG. 14. The resulting insulation crimp barrel 128 is circular. It has a solid circular lower part 142 which is a contiguous extension of the lower part 132 of the wire crimp barrel 126 and a split circular upper part 144 which is separated from the upper part 134 of the wire crimp barrel 126 by a narrow slit 150 which results from the transverse slits 150*b*** in the blank.

Figure 11:
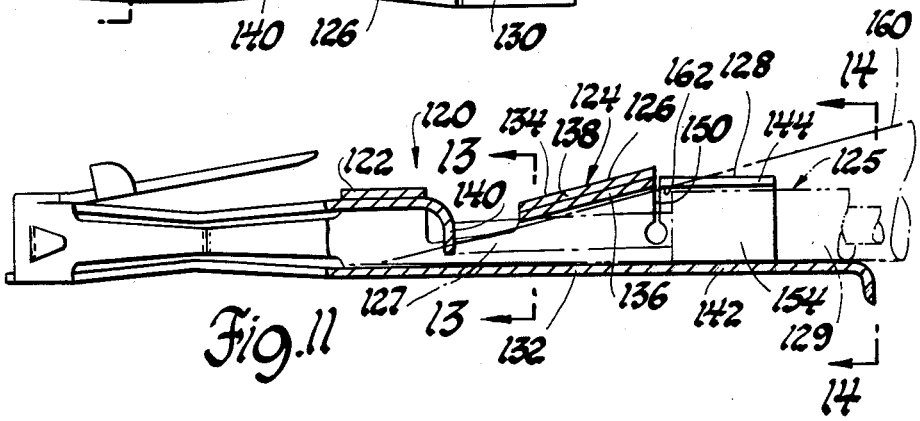
FIG. 11 is a longitudinal section taken along the line 11—11 of FIG. 10.

The inside surface of the wire crimp barrel 126 circumscribes an imaginary conical surface 160 shown in phantom in FIGS. 11, 13 and 14. As shown in FIG. 13, the majority of the wire crimp barrel 126 including the inner lip 136 lies on the imaginary conical surface 160. As shown in FIGS. 11 and 14, the end 162 of the insulation crimp barrel 128 also lies on the imaginary conical surface 160 so that the split upper part 144 is behind the large diameter end of the axial inner lip 136 with only a narrow slit 150 therebetween. Consequently, the cylindrical insulation crimp barrel 128 is also shaped so that the conductor wire does not hang up on the inner lip 136 of the wire crimp barrel 126 during insertion, while being reduced in size for compatibility with the female socket contact 122 of small cross section.

The electrical connector 120 is attached to the insulated conductor 125 which is prepared as before by stripping a length of insulation to expose an end portion of the stranded conductor wire 127. The conductor wire 127 is then inserted into the wire crimp barrel 126 and the insulation crimp barrel 128 as shown in phantom in FIG. 11. As stated earlier the insulation crimp barrel 128 is shaped so that the conductor wire 127 does not hang up on the inner lip 136 during insertion and the overlapping inner lip 136 improves containment of the stranded conductor wire 127 since not even one strand can pass out of the wire crimp barrel 126 between the inner lip 136 and the cooperating outer lip 138 which it engages.

The length of the exposed conductor wire 127 is preferably such that it extends out the end of the wire crimp barrel 126 and engages the stop tab 140 to properly locate the insulation jacket 129 and prevent the insulation jacket 129 entering the wire crimp barrel 126.

Figure 12:
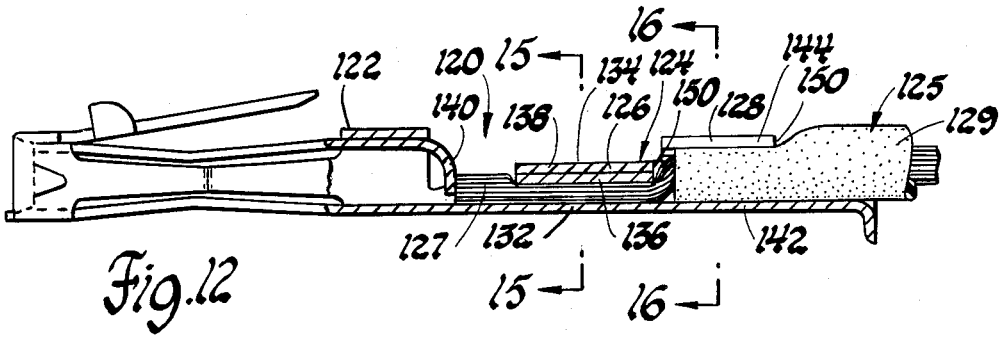
FIG. 12 is a longitudinal section similar to FIG. 11 showing the electrical connector crimped to an insulated conductor wire.
Figure 15:
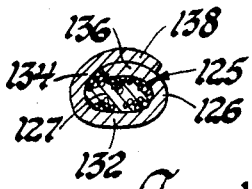
FIG. 15 is a section taken substantially along the line 15—15 of FIG. 12.
Figure 16:
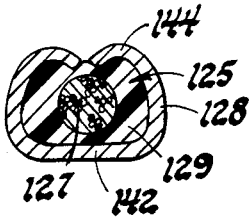
FIG. 16 is a section taken substantially along the line 16—16 of FIG. 12.

The wire and insulation crimp barrel 126 and 128 are then crimped tightly around the conductor wire 127 and the insulation jacket 129, respectively, as shown in FIGS. 12, 15 and 16.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector having attachment means for attaching the electrical connector to a conductor wire which comprise a wire crimp barrel and an insulation crimp barrel characterized in that:

the wire crimp barrel is funnel-shaped in the axial direction to facilitate insertion of a conductor wire and accommodate a range of conductor wire diameters, and partially overlapped inthe circumferential direction so that the funnel-shaped wire crimp barrel has an inner axial lip engaging an inner surface of an outer axial lip of the funnel-shaped wire crimp barrel to improve containment of the inserted conductor wire inwardly of the wire crimp barrel and the attachment means further comprise a guide means which includes the insulation crimp barrel being spaced from the overlapped portion of the wire crimp barrel by a narrow slit and being shaped so that the wire conductor does not hang up on the inner axial lip of the wire crimp barrel during insertion.

2. An electrical connector in accordance with claim 1 characterized in that:

the insulation crimp barrel is a circular cylinder which has a split in the axial direction which is behind the inner axial lip of the wire crimp barrel.

3. An electrical connector in accordance with claim 1 characterized in that:

the insulation crimp barrel is funnel-shaped in the axial direction to engage the insulation jacket of the conductor wire and prevent entry of the insulation jacket into the wire crimp barrel, and partially overlapped in the circumferential direction so that the funnel-shaped insulation crimp barrel has an inner axial lip which is behind the inner axial lip of the wire crimp barrel, the guide means include a ring which is behind the insulation crimp barrel and which has a split in the axial direction which is behind the inner axial lip of the insulation crimp barrel.

4. An electrical connector having attachment means for attaching the electrical connector to a conductor wire which comprise a wire crimp barrel characterized in that:

the wire crimp barrel is funnel-shaped in the axial direction to facilitate insertion of a conductor wire and accommodate a range of conductor wire diameters, and partially overlapped in the circumferential direction so that the funnel-shaped wire crimp barrel has an inner axial lip engaging an inner surface of an outer axial lip of the funnel-shaped wire crimp barrel to improve containment of the inserted conductor wire inwardly of the wire crimp barrel, the wire crimp barrel circumscribes an imaginary conical surface and a majority of the wire crimp barrel including the inner axial lip lies on the imaginary conical surface, the attachment means further comprise a guide means which is shaped so that the wire conductor does not hang up on the inner axial lip of the wire crimp barrel during insertion, and the guide means includes a split, cylindrical insulation crimp barrel which lies on the imaginary conical surface at its end nearest the wire crimp barrel.

5. An electrical connector having attachment means for attaching the electrical connector to a conductor wire which comprise a wire crimp barrel characterized in that:

the wire crimp barrel is funnel-shaped in the axial direction to facilitate insertion of a conductor wire and accommodate a range of conductor wire diameters, and partially overlapped in the circumferential direction so that the funnel-shaped wire crimp barrel has an inner axial lip engaging an inner surface of an outer axial lip of the funnel-shaped wire crimp barrel to improve containment of the inserted conductor wire inwardly of the wire crimp barrel, the wire crimp barrel circumscribes an imaginary conical surface and a majority of the wire crimp barrel including the inner axial lip lies on the imaginary conical surface, the attachment means further comprise a guide means which is shaped so that the wire conductor does not hang up on the inner axial lip of the wire crimp barrel during insertion, and the guide means includes a split, circular funnel-shaped guide ring which lies on the imaginary conical surface at least at its end nearest the wire crimp barrel, and an intermediate insulation crimp barrel which is funnel-shaped in the axial direction and partially overlapped in the circumferential direction so that a majority of the insulation crimp barrel lies on the imaginary conical surface with its inner axial lip behind the inner axial lip of the wire crimp barrel.

* * * * *